US006064318A

United States Patent [19]

Kirchner, III et al.

[11] Patent Number: 6,064,318

[45] **Date of Patent: *May 16, 2000**

[54] AUTOMATED DATA ACQUISITION AND PROCESSING OF TRAFFIC INFORMATION IN REAL-TIME SYSTEM AND METHOD FOR SAME

[75] Inventors: Albert H. Kirchner, III, Great Falls, Va.; Loren Staplin, Allentown; Kenneth W. Gish, Bensalem, both of Pa.

[73] Assignee: The Scientex Corporation, Arlington, Va.

[ * ] Notice: This patent issued on a continued prosecution application filed under 37 CFR 1.53(d), and is subject to the twenty year patent term provisions of 35 U.S.C. 154(a)(2).

[21] Appl. No.: 08/873,239

[22] Filed: Jun. 11, 1997

[51] Int. Cl.[7] ..... G08G 1/09

[52] U.S. Cl. ..... 340/905; 340/933; 340/936; 340/937; 340/908

[58] Field of Search ..... 340/933, 936, 340/908, 937, 589, 904, 905, 916, 917, 919

[56] References Cited

U.S. PATENT DOCUMENTS

| | | | |
|---|---|---|---|
| 5,214,793 | 5/1993 | Conway et al. | 455/49.1 |
| 5,231,393 | 7/1993 | Strickland | 340/936 |
| 5,257,020 | 10/1993 | Morse | 340/908 |
| 5,617,086 | 4/1997 | Klashinsky et al. | 340/907 |
| 5,673,039 | 9/1997 | Pietzsch et al. | 340/905 |
| 5,710,554 | 1/1998 | Pettler et al. | 340/905 |
| 5,729,214 | 3/1998 | Moore | 340/905 |
| 5,900,826 | 5/1999 | Farber | 340/908 |

OTHER PUBLICATIONS

"Smart Work Zone," ADDCO Portable Work Zone Safety System Components specification document; ADDCO, St. Paul, Minnesota.

*Primary Examiner*—Daryl Pope

*Attorney, Agent, or Firm*—Reed Smith Hazel & Thomas LLP

[57] ABSTRACT

The present invention is directed to a portable system for automatic data acquisition and processing of traffic information in real-time. The system incorporates a plurality of sensors operatively positioned upstream of a work zone or roadway incident with each of the sensors being adapted to detect current traffic conditions, at least one variable message device positioned upstream of the work zone or roadway incident, a plurality of remote station controllers, each operatively connected to the plurality of sensors and the variable message device, and a central system controller located within remote communication range of the remote station controllers, wherein the central system controller and the plurality of remote station controllers are capable of remotely communicating with one another. Each of the sensors is adapted to output traffic condition data to its corresponding remote station controller. The corresponding remote station controllers then transmit the traffic condition data to the central system controller. The central system controller automatically generates traffic advisory data based on the traffic condition data and transmits the traffic advisory data to the remote station controller that is connected to the variable message device. The traffic advisory data may also be used to communicate with and control highway advisory radio transmitters and ramp metering stations. Together, one or more variable message devices, highway advisory radio transmitters and ramp metering stations may be used to inform passing motorists of traffic conditions in and around a work zone or roadway incident, and thereby control and improve the safety and efficiency of traffic operations around such sites.

50 Claims, 3 Drawing Sheets

AUTOMATED DATA ACQUISITION AND PROCESSING OF TRAFFIC INFORMATION IN REAL-TIME SYSTEM AND METHOD FOR SAME

Work on the invention that is the subject of this application was conducted under the Work Zone Traffic Control System Cooperative Agreement with the Federal Highway Administration and the Maryland State Highway Administration. Both the Federal Government and the Maryland State Government may have rights in the invention as set forth in the above-referenced contract(s).

BACKGROUND OF THE INVENTION

1. Field of the Invention

The present invention is directed to a system and method for the automated data acquisition and processing of traffic information in real time. Specifically, the present invention provides a system whereby up-to-the-minute information on the current traffic conditions surrounding a work zone or an incident on the road (e.g., a traffic accident) is communicated to drivers upstream of the work zone or incident via any number of independent visual or auditory display devices under common, wireless control.

2. Description of the Prior Art

Currently, systems used in controlling traffic conditions around work zones and incidents on the road are limited to the use of conventional static signs, flashing arrow signs, portable variable message signs (VMS) programmed with a single repeating message, or no signs at all. These methods provide little or no information useful to drivers for either avoiding the development of a traffic jam or finding alternative routes. Though portions of the highways close to large metropolitan areas are often equipped with permanently installed VMSs and traffic signal lights designed to control the in-flow or out-flow of traffic in the highways, there are large stretches of highways that lack any facilities for controlling the flow of traffic on the highway that are usable around work zones or incidents on the road. Rather, the same conventional methods with the same conventional equipment as described above are used and provide the same limited information to drivers. Even if permanently installed VMSs are available, current methods in the use of such devices also provide very limited information for drivers in avoiding traffic jams due to the presence of work areas and/or roadside incidents, and such information is not credible because the messages they convey are typically not appropriate to existing conditions.

Therefore, there exists a need for a system that can provide up-to-the-minute information on the current traffic conditions around a work zone or roadway incident such that drivers are able to use information to either change their speed or lane position to avoid traffic jams, or find and navigate alternative routes.

Finally, there exists a need for a system that can monitor the current traffic conditions such that the data provided by the system to drivers on the road is understood to be pertinent to those current conditions, at a specified point in time, thereby maximizing the usefulness of the outputted information.

SUMMARY OF THE INVENTION

One of the main objectives of the present invention, therefore, is to make available a system that can provide up-to-the-minute information on the current traffic conditions around a work zone or roadway incident such that drivers are able to use information to either change their speed or lane position to avoid traffic jams or find alternative routes.

Concurrently, another main objective of the present invention is to provide a system that can monitor the current traffic conditions such that the data provided by the system to drivers on the road is pertinent to those current conditions, and the credibility and usefulness of the outputted information is maximized.

A further objective of the present invention is to provide an automated system that monitors the current traffic conditions such that the data provided by the system to drivers on the road is pertinent to those current conditions and that provides up-to-the-minute information on the current traffic conditions around a work zone or roadway incident to drivers, wherein the system is capable of operating automatically without operator intervention after deployment and system initialization through the use of a computer or other equivalent data processing device.

An even further objective of the present invention is to provide a system that monitors the current traffic conditions such that the data provided by the system to drivers on the road is pertinent to those current conditions and that provides up-to-the-minute information on the current traffic conditions around a work zone or roadway incident to drivers, wherein components of the system are designed to be moved and re-deployed to different operating sites with minimum time and effort.

In a first aspect of the system, the present invention is directed to a system for monitoring and processing traffic information at or near work zones or roadway incidents so as to provide real-time traffic advisory information to passing motorists. The system incorporates a plurality of sensor means for detecting current traffic conditions at least one of upstream of a work zone or roadway incident, at least one display means positioned upstream of the work, zone or roadway incident for displaying traffic information to passing motorists, a plurality of first control means each operatively positioned and connected with each of the plurality of sensor means and the display means for receiving sensor data and processing real-time traffic information to be displayed, respectively, and second control means communicatively connected to the plurality of first control means for controlling operation of the plurality of first control means. The second control means includes means for receiving the sensor data from the plurality of sensor means via corresponding ones of the plurality of first control means connected to the plurality of sensor means, means for generating the real-time traffic information to be displayed based on the sensor data, and means for transmitting the traffic information to be displayed to a corresponding one of the plurality of first control means connected to the display means.

In a second aspect, the present invention is directed to a portable system for automatic data acquisition and processing of traffic information in real-time. The system incorporates a plurality of sensors operatively positioned upstream of a work zone or roadway incident, each of the sensors being adapted to detect current traffic conditions, at least one variable message device operatively positioned upstream of the work zone or roadway incident; a plurality of remote station controllers, each operatively connected to a corresponding one of the plurality of sensors and at least one variable message device; and a central system controller operatively located within remote communication range of the plurality of remote station controllers, the central system controller and the plurality of remote station controllers, each having means for remotely communicating with one another. Each of the plurality of sensors is adapted to output traffic condition data to a corresponding one of the plurality of remote station controllers. The corresponding ones of the remote station controllers are adapted to transmit the traffic condition data to the central system controller. The central system controller further includes means for generating traffic advisory data based on the traffic condition data, the central system controller being adapted to transmit the traffic advisory data to at least a selected one of the plurality of remote station controllers operatively connected to at least one variable message and/or radio device, whereby traffic advisory messages are displayed based on the traffic advisory data.

In a third aspect, the present invention is directed to a method for monitoring and processing traffic information at or near work zones or roadway incidents so as to provide real-time traffic advisory information to passing motorists. The method comprises the steps of continuously detecting current traffic conditions upstream of a work zone or roadway incident, automatically generating traffic advisory data based on the detected traffic conditions, and displaying traffic advisory messages to passing motorists upstream of the work zone or roadway incident based on the traffic advisory data. The step of detecting the current traffic conditions includes providing a plurality of sensors upstream of the work zone or roadway incident to quantify conditions indicative of current traffic operations.

In a further aspect, the present invention is directed to a method for controlling operation of an automated traffic information monitoring and processing system that includes at least a plurality of sensors for detecting current traffic conditions; at least one variable message device; a plurality of remote station controllers, each operatively connected to corresponding ones of the plurality of sensors and at least one variable message device; and a central system controller operatively located within remote communication range of the plurality of remote station controllers. The method incorporates the steps of receiving traffic condition data from remote station controllers connected to the plurality of sensors, which continuously detect traffic conditions upstream of a work zone or roadway incident; generating traffic advisory data via the central system controller based on the received traffic condition data; then transmitting the traffic advisory data to the plurality of remote station controllers processing the traffic advisory data in each of the plurality of remote station controllers, and displaying traffic advisory messages on at least one variable message device.

BRIEF DESCRIPTION OF THE DRAWINGS

The invention will now be described in conjunction with the attached drawings, wherein.

DETAILED DESCRIPTION OF THE PREFERRED EMBODIMENTS

Figure 1:
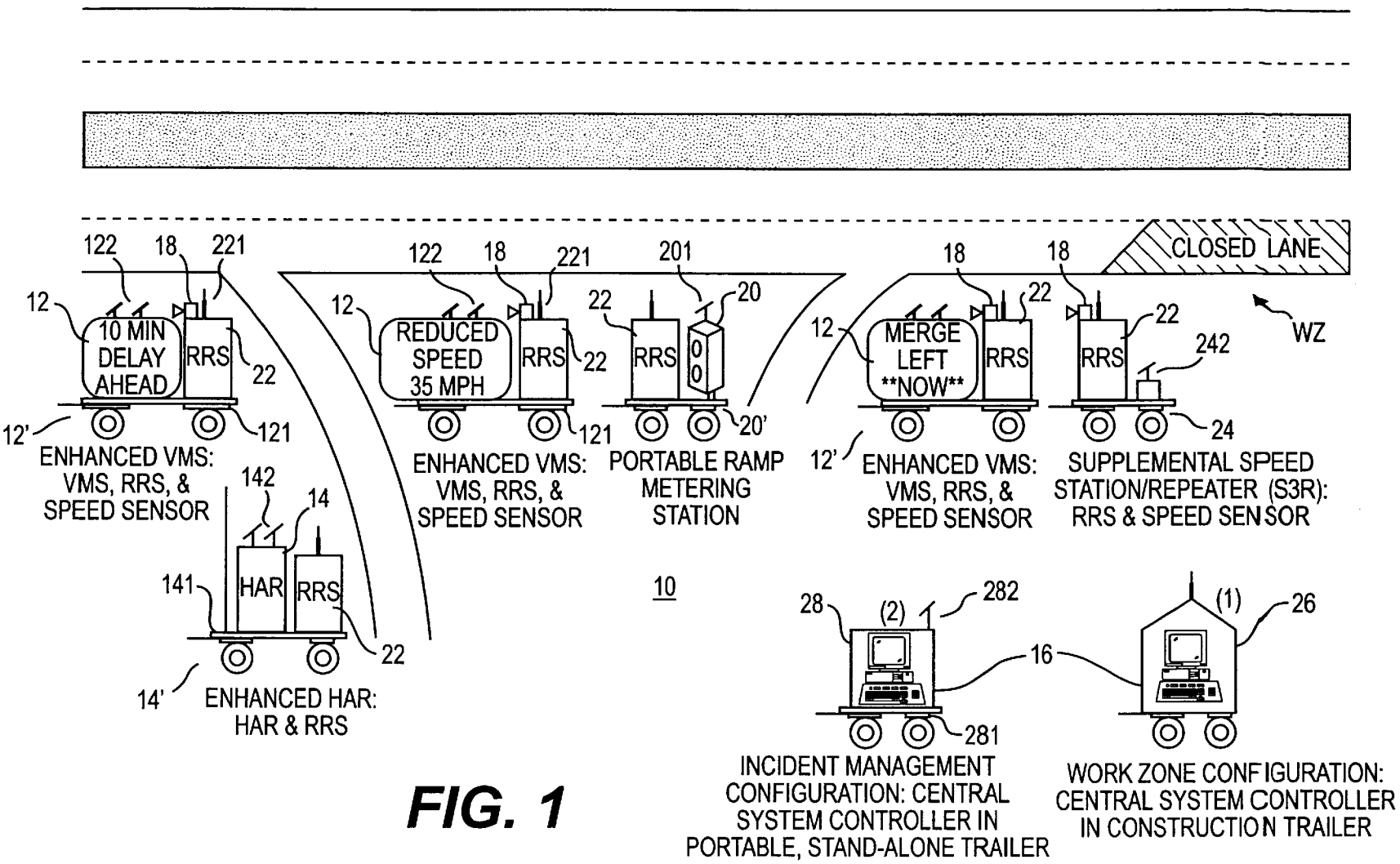
FIG. 1 is a general system diagram of the system according to a preferred embodiment of the present invention.

With reference to the figures, like reference characters will be used to indicate like elements throughout the several embodiments and views thereof. In particular, with reference to FIGS. 1 and 2, the system 10 is generally composed of six basic elements. One or more portable variable message signs (VMS) 12 are deployed upstream of a work zone (WZ) or incident site (IS) to convey real-time traffic information to passing motorists.

At least one highway advisory radio (HAR) 14 may be used to provide more detailed traffic information than can be accommodated by the VMSs 12. If there is an alternate route available, the HAR 14 can provide supplemental route navigation instructions in the event the system determines that the diversion of traffic is recommended or necessary.

An on-site central system controller (CSC) 16 is connected via a conventional communications system to control the various elements of the system 10. To enable the system 10 to respond to traffic conditions in real-time, traffic sensors 18 continuously acquire traffic data at multiple locations within and upstream of the work zone or incident site WZ. Portable ramp metering signals 20 are used to limit access to the roadway during conditions of heavy congestion. Roadside remote stations (RRS) 22 are used to receive traffic data from the sensors 18 and, under control from the CSC 16, to program the VMSs 12 to display and the HAR 14 to broadcast messages appropriate to current traffic conditions. RRSs 22 also control the signal timing of the portable ramp metering signals 20.

In the physical implementation of the system 10, the VMSs 12, the HARs 14, the sensors 18 and the portable ramp metering signals 20 may all be implemented using conventional devices used to perform their functions, such as an ADDCO Model No. DH 1000 which may be used as a VMS 12. An Information Station Specialists Model No. Alert AM may be used as the HAR 14. Whelen Engineering Model TDW-10 sensors may be used for the traffic sensors 18, and the ramp metering signals 20 may be implemented using conventional traffic signals portably mounted with a RRS 22 and a power supply 242. The central system controller (CSC) 16 may be implemented using an IBM-compatible PC or equivalent programmable data processing device with the necessary software designed to control the components of the system 10, as will be explained in more detail hereinbelow. The components that are physically located near one another may be connected to one another via conventional communication networking, such as RS-232 serial type. Those that are remotely located from one another may be communicatively connected via conventional RF transmitters and receivers in the UHF spectrum. In addition, by using an IBM-compatible PC or equivalent programmable data processing device as the basis for the CSC 16 and RRSs 22 in each of the components of the system networked to the CSC 16, the system 10 is intended to operate in a completely automated fashion after its deployment and system initialization.

Figure 2:
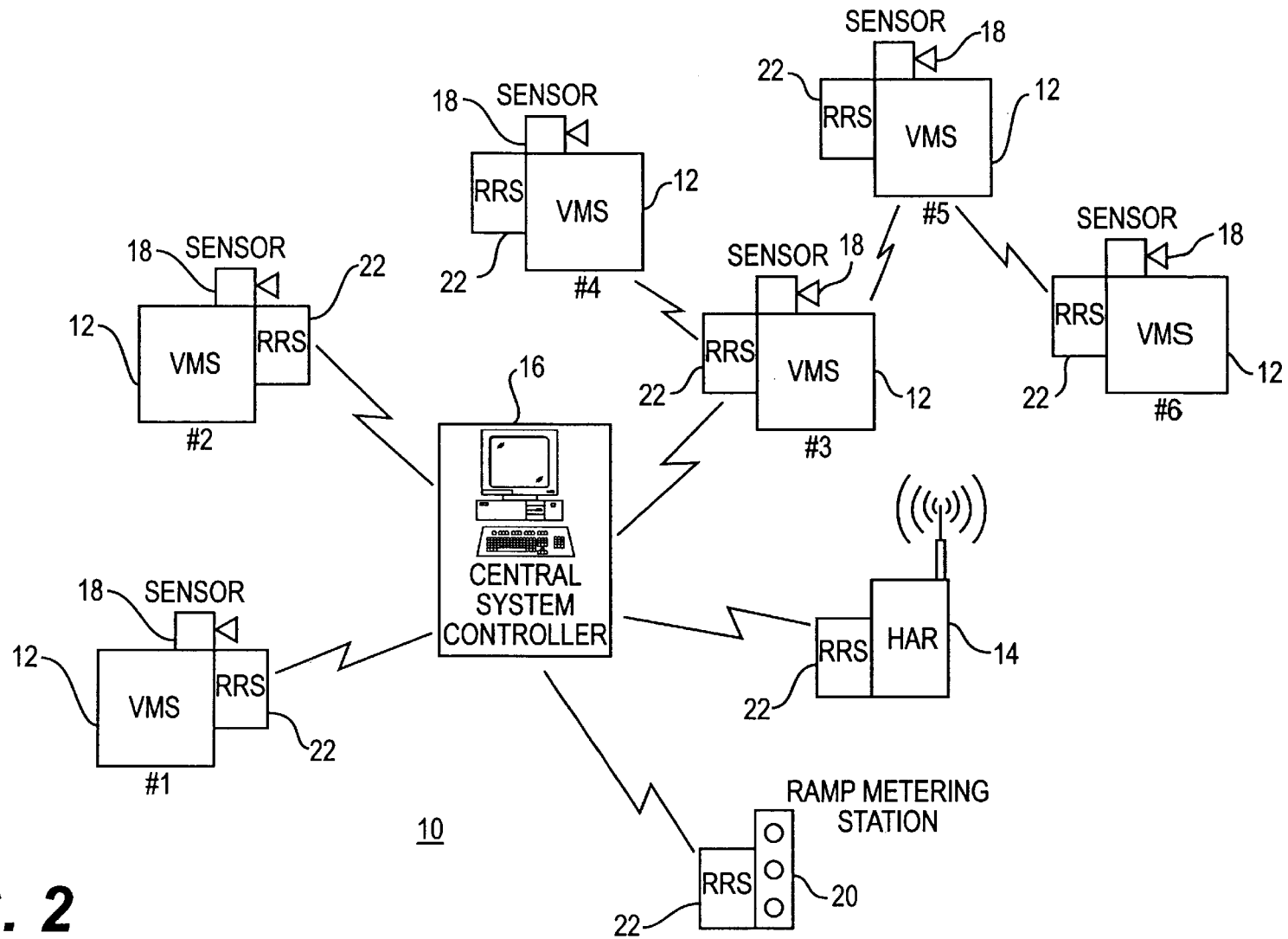
FIG. 2 is a system diagram illustrating the communication between the components of the system according to the present invention.

In a preferred embodiment, the above-described elements may be implemented as separate components that are operatively and communicatively connected to one another or combined into several functional groups as depicted in FIGS. 1 and 2. As shown, an enhanced embodiment of the VMSs 12' may integrate an RRS 22 and a traffic sensor 18 with a portable VMS 12. The RRS 22 and traffic sensor 18 may be physically mounted on the portable VMS's trailer 121 and supplied with electrical power by the portable VMS's own power source 122. The portable VMS 12 may also serve as a mount for the RRS's communications antenna 221.

An enhanced version of the HARs 14' may be composed of a portable HAR 14 and an RRS 22. As in the enhanced VMS grouping 12', the RRS 22 of an enhanced HAR 14' is physically mounted on the portable HAR's trailer 141 and is supplied with electrical power by the portable HAR's power supply 142.

Portable ramp metering stations 20' may be formed by combining portable ramp metering signals 20 with an RRS 22 and a trailer equipped with a solar- or diesel-generator-based power supply 201.

Supplemental speed station/repeater units ($S^3Rs$) 24 for deploying additional traffic sensors 18 may comprise an RRS 22, a traffic sensor 18 and a trailer 241 equipped with a solar- or diesel-generator-based power supply 242.

Within the preferred embodiment of the present invention as described above, there are two configurations of the system 10 which differ in the deployment of the CSC 16; they are (1) a work zone configuration and (2) an incident management configuration. In the work zone configuration, the CSC 16 may be located in a construction trailer 26 at the work zone WZ. The construction trailer 26 is equipped to provide a long-term source of electrical power, security from theft and vandalism, and a benign operating environment. In addition, use of construction trailers typically allows the provision of a telephone connection enabling the system 10 to be monitored and controlled remotely. In the incident management configuration, the CSC 16 is located in an environmental and security enclosure 28 mounted on a trailer 281 equipped with a solar- or diesel-generator-based power supply 282. This configuration for locating and enclosing the CSC 16 minimizes the time necessary for deploying the CSC 16 and the system 10 as a whole. As a whole, the selection of the components in the system 10, examples of which are described above, is intended to make every element in the system 10 portable, thereby allowing the system to be moved and re-deployed to different operating sites with minimum time and effort.

Figure 3:
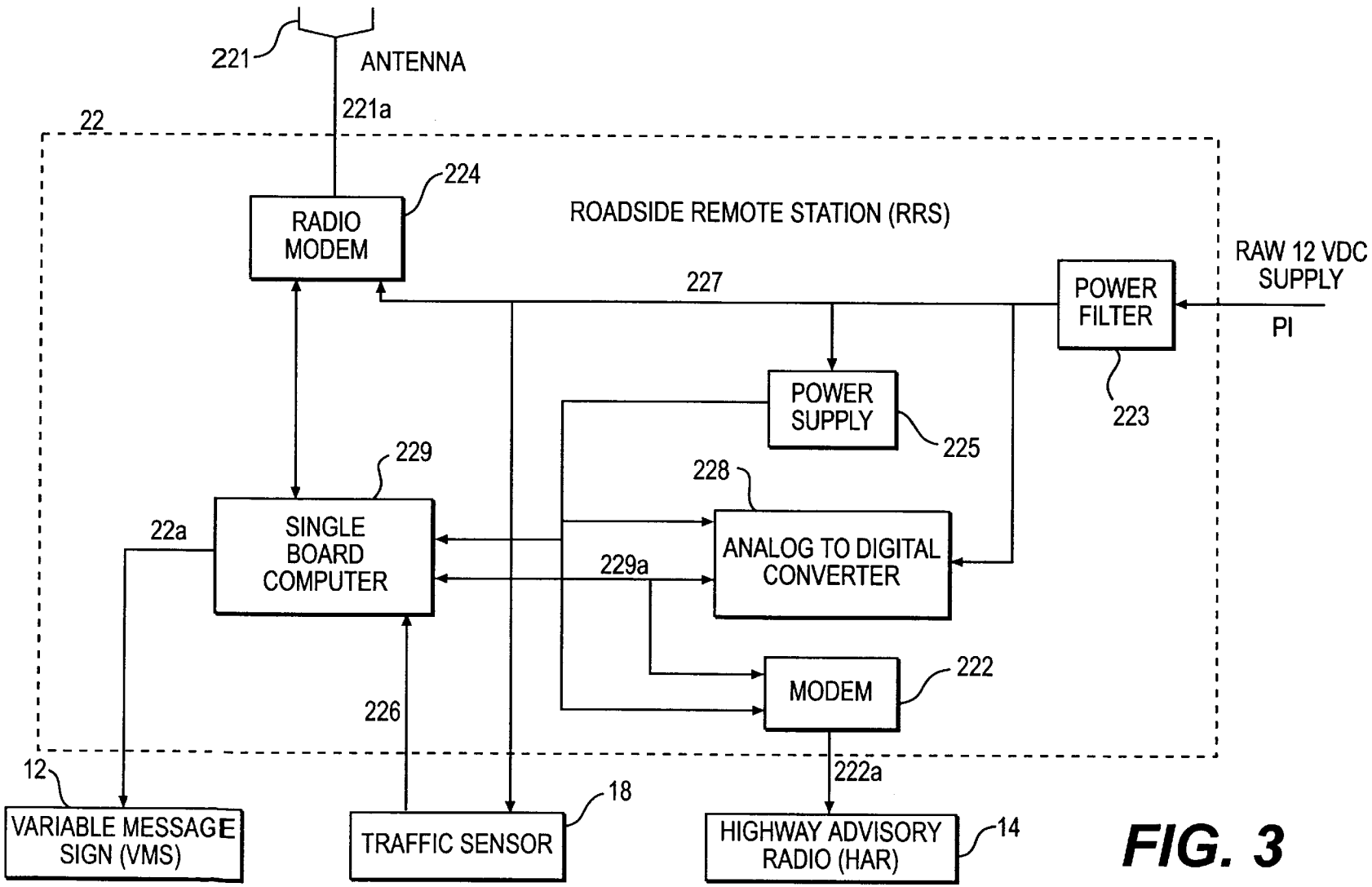
FIG. 3 is a system block diagram of the Roadside Remote Station (RRS) according to the preferred embodiment of the present invention.

The RRS 22 is a key component of the present invention designed specifically for the implementation and operation of the system 10. A block diagram of the RRS is shown in FIG. 3. The RRS 22 is supplied with nominal 12 volt DC power through the power input connection PI. A power filter 223 removes electrical noise and protects the RRS hardware from electrical transients. The power filter 223 supplies conditioned 12 VDC power to the radio modem 224, the power supply 225, and the traffic sensor 18 via a filtered power bus 227. An analog-to-digital converter (A/D) 228 measures the voltage of the filtered power bus 227. The power supply 225 converts the filtered nominal 12 VDC supplied by the filtered power bus 225 into 5 VDC to supply the single board computer circuit 229, the A/D converter 228 and a second modem 222. The radio modem 224 is equipped with an antenna 221.

In the preferred embodiment, the power supply 225 is an Octagon Systems Model 7112. The power filter 223 is implemented using conventional components known in the art. The radio modem 224 is formed using a Motorola Model K44GNM1001A RNet 9600 baud telemetry modem. The A/D converter 228 uses an Octagon 5720 8-bit analog input circuit. The single board computer circuit 229 is implemented using an Octagon Systems Model 4020 circuit or equivalent. The antenna 221 is implemented with an antenna known in the art applicable for use with the above-mentioned radio modem 224 or its equivalents, and the modem 222 is implemented using a ZOOM 2400 baud DTMF fax modem or equivalents.

In the operation of the system 10, the traffic sensor 18 periodically transmits traffic speeds to the single board computer 229 via an RS-232 compatible serial interface 226. Software running on the single board computer 229 receives speed data from the traffic sensor 18 and stores it.

The antenna 221 connected to the radio modem 224 can receive radio frequency (RF) communication signals from either another RRS 22 or the central system controller 16, and conveys the RF signal to the radio modem 224, such as via an antenna cable 221*a*. The radio modem 224 converts the RF signal into a serial data stream. The serial data from the radio modem 224 is then conveyed to the single board computer 229 via the RS-232 compatible serial interface 226. The single board computer 229 interprets the serial data stream from the radio modem 224 based on the communications protocol and the data packet format all to be explained hereinbelow.

In the general operation of the RRSs 22, the serial data streams they receive are analyzed by their single board computers 229 in order to extract the information therein, including data packet addresses. If analysis of the data packet addresses indicates that the receiving RRS is to respond, the single board computer 229 evaluates the packet's command field and performs the designated action. Valid commands and their associated actions will also be described hereinbelow.

If the data packet directs a RRS 22 to measure and return the voltage present on its filtered power bus 227, the single board computer 229 uses an ISA bus interface 229*a* to program the A/D Converter 228 to select the appropriate input and return a digital value corresponding to the voltage present on the filtered power bus 227.

If the data packet directs the RRS 22 to transfer a sequence of data bytes to a VMS 12, the RRS 22 does so using an RS-232 compatible serial interface 22*a* connecting it to the VMS 12.

If the data packet directs the RRS 22 to program a HAR 14, the RRS 22 uses an ISA bus interface 22*b* connecting it to a modem 222 to program the modem into generating Dual-Tone-Multiple-Frequency (DTMF) tones corresponding to the characters in the data packet. The modem 222 then transmits the DTMF tones to the HAR 14 via its telephone interface 222*a*.

Data Acquisition and Communications

In the general operation of the entire system 10 as illustrated in FIG. 2, the network of RRSs 22 are continuously receiving speed data from their corresponding sensors 18. At regular intervals such as every minute or as required by the specific application, the CSC 16 acquires the traffic data from the RRSs 22 using a radio modem identical to the radio modem 224 in each RRS 22. Like any other wireless communications system, the performance of the system 10 is highly dependent on local topographic factors. However, the system's communications sub-system has demonstrated a range in excess of three miles based on the above-described implementation of the system 10. To insure the system can be deployed at any incident or work zone site, each of the RRSs 22 is also designed to serve as a communications repeater, relaying commands to and data from RRSs 22 beyond the direct communications range of the CSC 16. When operating as communications repeaters, RRSs still receive data from their corresponding sensors 18 and can control a VMS 12, HAR 14 or ramp metering signal 20 as required. The CSC 16 configures the communications mode of each RRS 22 during system initialization. By using RRSs 22 as repeaters to relay commands and data, the system 10 can support incident sites or work zones of essentially unlimited length and of any topography.

Since any wireless communications system is subject to noise and other forms of interference, the system's communications protocol, which is explained in further detail hereinbelow, is designed with a mechanism for detecting when communications have been corrupted. When either the CSC 16 or an RRS 22 detects a garbled communications packet, the invalid packet is re-transmitted until it is received properly. This process insures the integrity of the system's critical data and command communications exchanges.

Traffic Data Processing and Advisory Message Selection

When traffic data from the RRSs 22 is acquired by the CSC 16, the CSC analyzes the data to predict delay and to detect hazardously low speeds (e.g., speeds of less than the posted speed limit) upstream of the incident site or work area. In the event of a deterioration in traffic conditions, the CSC 22 warns drivers using the VMSs 12 and optionally one HAR 14, and if necessary regulates access to the freeway using the ramp metering signals 20. The CSC 16 selects from several different classes of messages in memory and can combine messages as needed to describe multiple scenarios, such as simultaneous delay and hazardous speed conditions. The following message types may be stored in memory: lane closure messages; speed advisory messages; delay messages; diversion messages; and time-stamp messages. In addition to its automated VMS message selection mode, as controlled by the CSC 16, the system 10 allows manual entry of messages for special circumstances.

Since the system 10 has access to real-time, quantitative traffic data as a result of the plurality of traffic sensors 18 connected to its network of RRSs 22, the speed advisory and delay messages can be very specific, enhancing credibility. The CSC 16 is programmed with templates for each speed advisory and delay message and "fills-in" the message with the appropriate speed or delay information based on the current traffic data that it receives and processes. For example, when the system 10 detects modest levels of congestion (e.g., 5 minutes ), the CSC 16 will output the necessary data to selected RRSs 22 in order to program the appropriate VMSs 12 to display the delay and speed advisory messages as shown below:

| Delay Message | Speed Advisory Message |
|---|---|
| 5 MIN<br>DELAY<br>AHEAD | SLOW TO<br>40 MPH<br>**NOW** |

In all cases, the actual level of delay and advisory speed presented by the system is derived from the current traffic conditions data. If, to continue from the previous example, traffic conditions were detected as deteriorating further, the CSC 16 will process the traffic data describing the deteriorating conditions and then transmit the necessary data to adjust the messages as shown below:

| Delay Message | Speed Advisory Message |
|---|---|
| 15 MIN<br>DELAY<br>AHEAD | SLOW TO<br>25 MPH<br>**NOW** |

If the system 10 were to detect severe congestion and delay, the CSC 16 may then output the necessary data to the appropriate RRSs 22 for programming a HAR 14 to transmit the appropriate messages recommending that drivers divert to an alternate route and even supplying route navigation instructions. An example VMS diversion message is shown below:

| Phase 1 | Phase 2 |
|---|---|
| ALT<br>ROUTE<br>EXIT 19 | TUNE<br>RADIO<br>530 AM |

Each VMS 12 may be programmed to display one or more of the message types, and different VMSs within the same network may display different message types. The CSC 16 selects messages for each VMS 12 independently, based on the current traffic speed downstream of the selected VMS, the predicted delay for the work zone or incident site as a whole, and the message types currently enabled on the selected VMS. Having determined the appropriate messages for the system's VMSs 12 and HAR 14, the CSC 16 will command the RRSs 22 controlling the corresponding equipment to update their messages if required.

As an enhancement to message credibility, the system's VMS and HAR messages are time-stamped; that is, they contain elements that specify when the message was last updated. The system automatically updates these messages. An example VMS speed advisory message and it's associated time-stamp message is shown below:

| Phase 1 | Phase 2 |
|---|---|
| ROADWORK<br>ADVISORY<br>2:24 PM | SLOW TO<br>25 MPH<br>**NOW** |

As another feature of the present invention, the RRSs 22 are designed to operate with solar-powered VMSs and HARs, thereby minimizing the level of maintenance required by the system in terms of having to replenish the power supplies of the individual components in the system 10. The supplemental speed station/repeater units 24 and portable ramp metering stations 20 also utilize solar energy power supplies. Since the availability of power produced by solar panels is affected by both the level and duration of sunlight, systems that rely on solar power are vulnerable to service interruptions due to cloudy weather or the reduction in the number of daylight hours during winter. To insure continuous operation of the system during times of low solar power output (e.g., dark or overcast days), the CSC 16 periodically commands each RRS 22 to measure its battery voltage. RRSs whose battery voltage is low are flagged by the CSC 16, whereby the necessary warnings are relayed to operators monitoring the system. Maintenance crews can then be dispatched to the flagged RRSs to either replace or recharge their batteries before the equipment shuts down.

System Communications Protocol

The central system controller (CSC) 16 communicates with the remote roadside stations (RRSs) 22 through the exchange of data packets via wireless modems. The format of these data packets is shown in detail hereinbelow. In at least this first embodiment, communication between the CSC 16 and the RRSs 22 is half duplex. In order to communicate with each other, the CSC 16 and each of the RRSs 22 has a unique network address. In at least this first embodiment, the address of the CSC is always 0, while the address of the deployed RRSs may range from 1 to 127. Each RRS is assigned an address during an initial system setup conducted by the CSC, and stores that address in non-volatile memory.

When, in the operation of its program, the CSC 16 is directed to retrieve traffic sensor data from an RRS 22 or change the output of a device (i.e., a VMS or HAR) connected to an RRS, the CSC 16 will build a command packet, address the data packet to the target RRS 22, and then transmit the data packet. In general, all of the RRSs 22 will receive the transmitted command packet(s) through their wireless radio modems 224 and process those data packets accordingly. As will be explained further hereinbelow, those RRSs 22 to which a particular data packet is not addressed will discard the packet without further processing. The RRS 22, to which a data packet is addressed, will transmit a response signal back to the CSC 16 to indicate either that the data packet has been properly received or that the data packet should be re-transmitted.

Correspondingly, after transmitting a RRS command packet intended for a particular RRS 22, the CSC 16 will not transmit a second command packet for that unit until it receives a response to the first command packet or until after an no-response time period activated by the CSC 16 expires.

In this preferred embodiment, during the specific operation of processing a data packet initially received from the CSC 16, a RRS 22 will evaluate the addresses in the FDEST and IDEST fields of the data packet to determine what processing, if any, it should perform. In general, there are three kinds of packet processing an RRS 22 may perform. If the addresses in both the FDEST and IDEST fields match the address of the RRS, the data packet is thereby determined as being intended specifically for that RRS. The RRS will then execute the command specified in the packet's CMD field and transmit a reply packet with the results of the operation.

If the neither the FDEST field nor the IDEST field matches the RRS's address, the RRS will discard the packet without implementing the command or replying.

If the IDEST field matches the RRS's address but the FDEST field does not, the RRS must re-transmit the packet without processing it, if it is configured to do so. This is referred to as repeater operation and is discussed in the following section.

Lastly, if the FDEST field matches the RRS's address but the IDEST field does not, this is the case of an RRS unexpectedly detecting a data packet ultimately intended for it but intended to be relayed through a repeater RRS first. In this case, the packet will be discarded without processing.

After receiving a data packet, the RRS 22 to which the packet is addressed will validate it. This validation takes the form of a CRC calculation on the packet, packet parameter consistency checks and verification of the RRS's internal state or configuration (i.e., repeater status, attached device type, etc.). If the packet passes the CRC check and other tests, the RRS 16 will process and perform the command specified in the CMD field of the data packet, and then transmit a reply packet with its CMDSTAT field set appropriately.

Repeater Operation

In the deployment of the system 10, one or several RRSs 22 may be beyond the range of direct communication with the CSC 16 or beyond within line-of-sight of the CSC 16 (See FIG. 2). In these circumstances, an intermediate RRS 22 is configured for repeater operation; that is, for re-transmitting command and data packets. By using one or more intermediate repeater RRSs 22 to relay command and reply packets, the CSC 16 can communicate with RRSs 16 beyond the maximum line-of-sight range. As noted above, operation as a repeater does not limit the operation of a RRS in any way; it still responds to command packets directed to it as would RRSs not configured as repeaters.

Referring to the system data packet definition explained hereinbelow, a data packet's IDEST field indicates the address of the next unit that should handle the packet. In order to act as an intermediary in the communication between the CSC 16 and another RRS 22, a repeater RRS 22 must receive a data packet whose IDEST field matches its own address, and then transmit the packet to the next RRS 22 in the "chain" connecting the CSC 16 to the final destination RRS 22 designated by the FDEST field. In this preferred embodiment, RRSs 22 acting as repeaters use a structure called a remap table, internal to its software, to re-address data packets prior to re-transmission. The remap table is the key to repeater operation since, taken as a whole, the remap tables of the repeater RRSs 22 describe the IDEST address path to those RRSs 22 not in direct communication with the CSC 16.

Once an RRS 22 is commanded into repeater mode and its remap table is loaded from the CSC 16, it will relay command and reply packets by replacing the address in the IDEST field of the data packet (which initially will be its own address) with the value extracted from its remap table using the FDEST address as an index. This address may be that of the final destination RRS or another repeater RRS, depending on the geometry of the RRSs deployed in the system 10. So that a data packet's next intended recipient knows to whom to send a reply signal, the repeater RRS also replaces the address in the SENDER field of the data packet with its own. The ORG field of the data packet, which indicates the address of the originator of the packet, remains unchanged. The repeater RRS 22 will then transmit the modified packet.

To demonstrate this process, the following example as illustrated in FIG. 2 shows communication between the CSC 16 and a RRS 22 having an address #6 using the RRSs 22 at addresses #3 and #5 as repeaters. Before it can transmit an otherwise complete command packet, the CSC 16 determine the proper value of the IDEST field in its own remap table stored in its software, so that the data packet will be transmitted to a repeater RRS if required. In this example, the CSC's remap table looks like the following:

| Remap Table | Explanation |
|---|---|
| 0 | Not used, we won't be talking to ourselves. |
| 1 | We're in direct communication with RRS #1. |
| 2 | We're in direct communication with RRS #2. |
| 3 | We're in direct communication with RRS #3. |
| 4 | We're NOT in direct communication with RRS #4. Send its packets to RRS #3 first. (RRS #3 is a repeater) |
| 5 | We're NOT in direct communication with RRS #5. Send its packets to RRS #3 first. (RRS #3 is a repeater) |
| 6 | We're NOT in direct communication with RRS #6. Send its packets to RRS #3 first. (RRS #3 is a repeater) |

-continued

| Remap Table | Explanation |
|---|---|
| — | (We're not in direct communication with any RRS past #3. Packets for an RRS past #3 must be sent to RRS #3 first, so the remaining 121 entries are also # 3.) |

Since the first element in the remap table is the element for address #0, the CSC 16 extracts element 6 (for the corresponding RRS address) from the table and inserts that address into the IDEST field of the data packet. In this example, the CSC 16 inserts the address of RRS #3. This insures that the packet will be routed to repeater RRS #3 first. The packet transmitted by the CSC 16 will then be configured as follows:

| Command Packet Sent by CSC | | Description |
|---|---|---|
| SOM | 0 × A5 | always 0 × A5 |
| FDEST | 6 | final destination is RRS #6 |
| IDEST | 3 | but packet goes to RRS #3 first |
| SENDER | 0 | transmitted by the CSC |
| ORG | 0 | originated by the CSC |
| (remaining fields omitted for clarity) | | |

During system initialization, RRS #3 was configured as a repeater; its remap table will appear as follows, as an example:

| IDEST Address | Explanation |
|---|---|
| 0 | We're in direct communication with the CSC. Any inbound replies get transmitted to it directly. |
| 1 | We're in direct communication with RRS #1. |
| 2 | We're in direct communication with RRS #2. |
| 3 | We're in direct communication with RRS #3. |
| 4 | We're in direct communication with RRS #4. |
| 5 | We're in direct communication with RRS #5. |
| 6 | We're NOT in direct communication with RRS #6. Send its packets to RRS #5 first. (RRS #5 is a repeater) |
| — | (We're not in direct communication with any RRS past #6. Packets for an RRS past #6 must be sent to RRS #3 first, so the remaining 120 entries are also #5.) |

After receiving the data packet from the CSC 16, repeater RRS #3 modifies the packet and re-transmits it. So that the recipient knows to whom to reply, RRS #3 inserts its address into the SENDER field. Next, it extracts the new address for the IDEST field from entry 6 (the value of the FDEST field in the original) of its remap table. The modified packet will then appear as follows:

| Command Packet Re-transmitted by RRS #3 | | Description |
|---|---|---|
| SOM | 0 × A5 | always 0 × A5 |
| FDEST | 6 | final destination is RRS #6 |
| IDEST | 5 | but packet goes to RRS #5 next |
| SENDER | 3 | transmitted by RRS #3 |
| ORG | 0 | originated by CSC |
| (remaining fields omitted for clarity) | | |

During system initialization, RRS #5 was also configured as a repeater; its remap table will have been configured as follows, as an example:

| IDEST Address | Explanation |
|---|---|
| 0 | We're NOT in direct communication with the CSC. Send its packets to RRS #3 first. (RRS #3 is a repeater) |
| 1 | We're NOT in direct communication with RRS #1. Send its packets to RRS #3 first. (RRS #3 is a repeater) |
| 2 | We're NOT in direct communication with RRS #2. Send its packets to RRS #3 first. (RRS #3 is a repeater) |
| 3 | We're in direct communication with RRS #3. |
| 4 | We're in direct communication with RRS #4. |
| 5 | We're in direct communication with RRS #5. |
| 6 | We're in direct communication with RRS #6. |
| — | (We're not in direct communication with any RRS past #6. Packets for an RRS past #6 must be sent to RRS #3 first, so the remaining 120 entries are also #6.) |

After receiving the data packet from RRS 3, repeater RRS #5 modifies it and re-transmits it. So that the recipient knows to whom to reply, RRS #5 inserts its address into the SENDER field. Next, it extracts the new address for the IDEST field from entry 6 (the FDEST field) of its remap table. The modified packet will therefore be configured as follows:

| Command Packet Re-transmitted by RRS 5 | | Description |
|---|---|---|
| SOM | 0 × A5 | always 0 × A5 |
| FDEST | 6 | final destination is RRS #6 |
| IDEST | 6 | packet goes to RRS #6 next |
| SENDER | 5 | transmitted by RRS #3 |
| ORG | 0 | originated by CSC |
| (remaining fields omitted for clarity) | | |

RRS #6 evaluates the data packet after receiving it from repeater RRS #5. Since both the FDEST and IDEST fields match its own address, RRS #6 validates the packet then executes the command within it. RRS #6 then transmits a reply data packet based on the results of executing the command from the CSC. That reply packet will appear as follows:

| Reply Packet Sent by RRS 6 | | Description |
|---|---|---|
| SOM | 0 × A5 | always 0 × A5 |
| FDEST | 0 | final destination is CSC (ORG field in command packet) |
| IDEST | 5 | but packet goes to RRS 5 first (SENDER field in command packet) |
| SENDER | 6 | transmitted by RRS #6 |
| ORG | 6 | originated by RRS #6 |
| (remaining fields omitted for clarity) | | |

After receiving the reply packet from the RRS #6, repeater RRS #5 modifies it and re-transmits it. So that the recipient knows where it came from, RRS #5 inserts its address into the SENDER field of the reply packet. Next, it extracts the new address for the IDEST field from entry 0 (the FDEST field) of its remap table. The modified packet will appear as follows:

| Reply Packet Re-transmitted by RRS 5 | | Description |
|---|---|---|
| SOM | 0 × A5 | always 0 × A5 |
| FDEST | 0 | final destination is CSC |
| IDEST | 3 | but packet goes to RRS #3 next |
| SENDER | 5 | transmitted by RRS #5 |
| ORG | 6 | originated by RRS #6 |
| (remaining fields omitted for clarity) | | |

Similarly, after receiving the reply packet from the RRS #5, repeater RRS #3 modifies it and re-transmits it. So that the recipient knows where it came from, RRS #3 inserts its address into the SENDER field of the reply packet. Next, it extracts the new address for the IDEST field from entry 0 (the FDEST field) of its remap table. This next modified packet will appear as follows:

| Reply Packet Re-transmitted by RRS 3 | | Description |
|---|---|---|
| SOM | 0 × A5 | always 0 × A5 |
| FDEST | 0 | final destination is CSC |
| IDEST | 0 | and that's where it's going next |
| SENDER | 3 | transmitted by RRS #3 |
| ORG | 6 | originated by RRS #6 |
| (remaining fields omitted for clarity | | |

As discussed above, communication between the CSC 16 and the network of RRSs 22 in the system 10 is accomplished using a specific data packet format, wherein the necessary address and command data are inserted in order to implement the necessary data transfers between the CSC 16 and designated RRSs and between RRSs. One example for the structure of the system data packet format and its component bytes for this preferred embodiment is illustrated and explained hereinbelow:

System Data Packet Format

| Byte # | Msg Field | Description |
|---|---|---|
| 0 | SOM | Start Of Message, always 0 × A5 |
| 1 | FDEST | Address of CSC (reply packet) or RRS for which this packet is ultimately intended (command packet) |
| 2 | IDEST | Address of next RRS to handle this packet |
| 3 | SENDER | Address of RRS or CSC that transmitted this packet |
| 4 | ORG | Address of packet originator |
| 5 | CMD | RRS command opcode |
| 6 | CMDSTAT | Bit mapped status field, refers to processing of last packet received. Set to 0 by CSC, set appropriately by RRS when replying. |
| 7 | RRSSTAT | Bit mapped status field, refers to current state of RRS. Set to 0 by CSC; set appropriately by RRS when replying. |
| 8 | MSGCNT | Set by CSC to reflect running total of messages transmitted; transmitted without modification by the RRS |
| 9 | DATALEN | Total number of DATA bytes in this packet |
| 10 | CRCMSB | Most significant byte of packet CRC |
| 11 | CRCLSB | Least significant byte of packet CRC |
| 12–225 | DATA | Optional variable length CMD-code-dependent information |

The fields of the System Data Packet are defined as follows:

SOM

The Start of Message Field is used to indicate the beginning of a packet. This byte will always have the value 0×A5.

FDEST

The final destination field indicates the address of the device which is to process the packet. Valid values are 0 (for an RRS replying to the CSC) and 1 through 127 (for an RRS command packet sent by the CSC).

IDEST

The intermediate destination field indicates the address of the next device to handle the packet, but not necessarily the device to process it. This field is used for communicating via repeater RRSs. This field is set equal to the FDEST field when the packet is transmitted to its final destination. Valid values are 0 (for an RRS replying to the CSC) and 1 through 127 (for an RRS command packet sent by the CSC).

SENDER

The SENDER field contains the address of the device that transmitted the packet. This may not be the same device that originated the packet if two devices are communicating via repeater RRSs. Valid values range are 0 (for an RRS command packet sent by the CSC) and 1 through 127 (for an RRS replying to the CSC).

ORG

This field contains the address of the first device to transmit the packet (the originator of the packet). This may not be the same device that most recently transmitted the packet if two devices are communicating via repeater RRSs. Valid values are 0 (for an RRS command packet sent by the CSC) and 1 through 127 (for an RRS replying to the CSC).

CMD

The command field contains a code corresponding to the operation the RRS is to perform. These command codes are defined in detail in Table 1 in the accompanying specification.

CMDSTAT

The CMDSTAT byte is returned by the RRS and represents the results of processing the last command packet intended for it. The byte is organized as a bit field; only one bit may be set at a time. Successful completion is indicated by returning a 0 in this field.

The CMDSTAT byte is defined as follows:

CMDSTAT Byte

| Bit 7 | Bit 6 | Bit 5 | Bit 4 | Bit 3 | Bit 2 | Bit 1 | Bit 0 |
|---|---|---|---|---|---|---|---|
| RRS busy | CRC error | CMD out of range | Configuration Error | Invalid Parameter | Device Did Not Respond | Health Test Error | Set Device Type Error |

The bit fields within the CMDSTAT byte are arranged in hierarchical order with bit 7 being the most severe error. For example, a 1 in bit 4 (Configuration Error) implies that the packet was received when the RRS was not busy, that the packet's CRC was correct, and that the value in the CMD field was legal.

In the implementation of the RRS 16, one example of the command opcodes for implementing the software of the RRS in this preferred embodiment is as follows:

RRS Command Opcodes

| CMD field | Description |
|---|---|
| 0 | NOP - no operation |
| 30 | Clear RESET bit in RRSSTAT field |
| 40 | Configure serial port |
| 50 | Write data to serial port |
| 60 | Become repeater, remap list attached |
| 61 | Cancel repeater status |
| 91 | Select active traffic data buffer |
| 105 | Return radar sensor speed data |
| 180 | Return input power voltage |
| 200 | Return RRS version |
| 210 | Retrieve extended statistics |
| 215 | Reset extended statistics |
| 255 | Reset RRS |

CMD 0: NOP

The RRS will reply without performing any further operations.

Data fields:

CMD Packet:

DATA field length: 0

DATA field: N/A

REPLY Packet:

DATA field length: 0

DATA field: N/A

CMD 30: Clear Reset Bit

The RRS will clear the RESET bit it reports in the RRSSTAT byte.

Data fields:

CMD Packet:

DATA field length: 0

DATA field: N/A

REPLY Packet:

DATA field length: 0

DATA field: N/A

CMD 40: Configure Serial Port

The RRS will configure the serial port indicated by byte 12 as specified in byte 13 as follows, provided that byte 12 does not specify the port connected to the RRS's RF modem:

CMD Packet:

DATA field length: 2

DATA field:

byte 12: serial port to be reconfigured (1–4)

byte 13:

| Bit 7 | Bit 6 | Bit 5 | Bit 4 | Bit 3 | Bit 2 | Bit 1 | Bit 0 |
|---|---|---|---|---|---|---|---|
| Baud 2 | Baud 1 | Baud 0 | Data Bits 1 | Data Bits 0 | Parity 1 | Parity 0 | Stop Bits |

Where:

| Bit 4 | Bit 3 | Data Bits |
|---|---|---|
| 0 | 0 | 8 |
| 0 | 1 | 7 |
| 1 | 0 | undefined |
| 1 | 1 | undefined |

| Bit 7 | Bit 6 | Bit 5 | Baud Rate |
|---|---|---|---|
| 0 | 0 | 0 | 300 |
| 0 | 0 | 1 | 1200 |
| 0 | 1 | 0 | 2400 |
| 0 | 1 | 1 | 4800 |
| 1 | 0 | 0 | 9600 |
| 1 | 0 | 1 | 19200 |
| 1 | 1 | 0 | Undefined |
| 1 | 1 | 1 | Undefined |

| Bit 2 | Bit 1 | Parity |
|---|---|---|
| 0 | 0 | None |
| 0 | 1 | Undefined |
| 1 | 0 | Even |
| 1 | 1 | Odd |

| Bit 0 | Stop Bits |
|---|---|
| 0 | 1 |
| 1 | 2 |

REPLY Packet:

DATA field length: 0

DATA field: N/A

CMD 50: Write Data to Serial Port

The RRS will copy the data string starting in byte 13 of the data section of the command packet to the serial port specified in byte 12 provided that byte 12 does not specify the port connected to the RRS's RF modem. The length of the data is equal to byte 9 of the packet (DATALEN) minus 1. The data must be no longer than 243 bytes.

Data fields:

CMD Packet:

DATA field length: 2–244

DATA field:

byte 12: serial port (1–4)

bytes 13–255: data to be transferred

REPLY Packet:

DATA field length: 0

DATA field: N/A

CMD 60: Become Repeater

The RRS will use the remap table in the data bytes to act as a repeater, indicating this status through bit 7 of the RRSSTAT field.

Data fields:

CMD Packet:

DATA field length: 32

DATA field: Remap table: packet byte 12 corresponds to the IDEST field for the unit at address 0 (the CSC), packet byte 13 corresponds to the network address 1, etc.

REPLY Packet:
DATA field length: 0
DATA field: N/A

CMD 61: Cancel Repeater Status

The RRS no longer acts as a repeater; it also clears bit 7 of its RRSSTAT field.

Data fields:

CMD Packet:
DATA field length: 0
DATA field: N/A

REPLY Packet:
DATA field length: 0
DATA field: N/A

CMD 91: Select Active Traffic Data Buffer

This command controls the destination of incoming traffic data from the sensor connected to the RRS. When the RRS powers up, it will arbitrarily designate one of its two traffic data buffers as buffer 0 and the other as buffer 1. Buffer 0 will be the first active buffer and buffer 1 the initial inactive buffer. All incoming traffic data will be routed to the buffer currently designated as the active buffer. Reception of command 110 causes the RRS to return the contents of the inactive buffer. Upon reception of a valid Select Active Traffic Data Buffer command, the RRS shall re-initialize the traffic buffer designated in byte 13 and utilize it as the active buffer until otherwise directed. By definition, the other traffic data buffer becomes the inactive buffer Data fields:

CMD Packet:
DATA field length: 1
DATA field: ID of active traffic data buffer (0 or 1)

REPLY Packet:
DATA field length: 0
DATA field: N/A

CMD 105: Return Radar Sensor Speed Data

This command returns radar sensor speed data from the RRS's currently inactive traffic data buffer.

Data fields:

CMD Packet:
DATA field length: 0
DATA field: N/A

REPLY Packet:
DATA field length: 4
DATA field:
Byte 12:
A hexadecimal value representing the average speed (in mph) measured since the last Select Active Traffic Data Buffer command was received.
Bytes 13–14:
A hexadecimal word (two bytes) representing the number of speed data points used in calculating the average speed reported in byte 12. Byte 13 is the MSB; byte 14 the LSB.
Byte 15:
The ID of the buffer from which the data was retrieved (0 or 1).

CMD 180: Return Input Power Voltage

This command causes the RRS to measure and return the DC voltage present at its 12 VDC power connector.

Data fields:

CMD Packet:
DATA field length: 0
DATA field: N/A

REPLY Packet:
DATA field length: 1
DATA field One byte representing the input power voltage in units of 60 mV.

CMD 200: Return RRS Version

Data fields:

CMD Packet:
DATA field length: 0
DATA field: N/A

REPLY Packet:
DATA field length: Variable, but less than 32
DATA field: A null-terminated ASCII string containing the version number and date CMD 210: Return Extended Statistics Data fields:

CMD Packet:
DATA field length: 0
DATA field: N/A

REPLY Packet:
DATA field length: TBD
DATA field: Extended statistics, format TBD CMD 215: Reset Extended Statistics Data fields:

CMD Packet:
DATA field length: 0
DATA field: N/A

REPLY Packet:
DATA field length: 0
DATA field: N/A

CMD 255: Reset

This command resets the RRS as if it had been powered-up.

Data fields:

CMD Packet:
DATA field length: 0
DATA field: N/A

REPLY Packet:
DATA field length: 0
DATA field: N/A

Although the present invention has been fully described in connection with the preferred embodiment thereof with reference to the accompanying drawings, it is to be noted that various changes and modifications will be apparent to those skilled in the art. For example, other devices for implementing the VMSs 12, the HAR 14, the supplemental speed station/repeater units 24 and the ramp metering stations 20, as known in the art, may be substituted for the components specified above for this preferred embodiment. Other data packet formats, software opcodes or software may be substituted for those specified above, also as known in the art, so long as the basic structure and operation of the present invention and their equivalents as disclosed herein are maintained. Other renewable or self-sustaining power sources/supplies may be substituted for those described above, so long as the remote and/or longterm operational capability of the system's components is maintained. Such changes and modifications are to be understood as included within the scope of the present invention as defined by the appended claims, unless they depart therefrom.

What is claimed is:

1. A system for monitoring and processing traffic information at or near work zones or roadway incidents so as to provide real-time traffic advisory information to passing motorists, the system comprising:

a plurality of sensor means for detecting current traffic conditions being relocatably positionable at least one of upstream of a work zone or roadway incident, said plurality of sensor means including speed sensors for detecting speeds of passing vehicles;

at least one display means relocatably positionable upstream of the work zone or roadway incident for displaying traffic information to passing motorists;

a plurality of first control means each operatively positioned and connected with each of said plurality of sensor means and said display means for receiving sensor data and processing real-time traffic information to be displayed, respectively; and second control means communicatively connected to said plurality of first control means for controlling operation of said plurality of first control means, wherein said second control means includes means for receiving said sensor data from said plurality of sensor means via corresponding ones of said plurality of first control means connected to said plurality of sensor means, means for generating said real-time traffic information to be displayed based on said sensor data, and means for transmitting said real-time traffic information to be displayed to a corresponding one of said plurality of first control means connected to said display means, wherein said real-time traffic information to be displayed includes at least one of upcoming traffic speed information, traffic time delay information and traffic advisory instruction information, and said plurality of sensor means and said display means are formed to be relocatably positionable relative to each other and to the work zone or roadway incident whereby locations of said plurality of sensors and said display means are reconfigurable to adapt operation of said system in accordance with current conditions and location of the work zone or roadway incident.

2. A system according to claim 1, further comprising:

means for transmitting supplemental traffic information to passing motorists via radio frequency (RF) signals, said transmitting means being operatively positioned and connected to a corresponding one of said plurality of first control means.

3. A system according to claim 1, further comprising:

ramp signal means for controlling entry of motorist traffic from ramps upstream of the work zone or roadway incident, said ramp signal means being operatively positioned and connected to a corresponding one of said plurality of first control means.

4. A system according to claim 1, wherein said plurality of first control means and said second control means each include means for operatively communicating with each other via RF signals.

5. A system according to claim 1, wherein said second control means includes means for automatically controlling operation of said plurality of first control means without operator intervention.

6. A portable system for automatic data acquisition and processing of traffic information in real-time, comprising:

a plurality of sensors operatively and relocatably positioned upstream of a work zone or roadway incident, each of said sensors being adapted to detect current traffic conditions, and each of said sensors including a speed sensor adapted to detect speeds of vehicles passing said plurality of sensors;

at least one variable message device operatively relocatably positioned upstream of the work zone or roadway incident;

a plurality of remote station controllers, each operatively connected to a corresponding one of said plurality of sensors and said at least one variable message device; and a central system controller operatively located within remote communication range of at least one of said plurality of remote station controllers, said central system controller and said plurality of remote station controllers each having means for remotely communicating with one another, wherein each of said plurality of sensors being adapted to output real-time traffic condition data to a corresponding one of said plurality of remote station controllers, said corresponding ones of said remote station controllers being adapted to transmit the traffic condition data to said central system controller, said central system controller further including means for generating real-time traffic advisory data based on the traffic condition data, said central system controller being adapted to transmit the traffic advisory data to at least a selected one of said plurality of remote station controllers operatively connected to said at least one variable message device, whereby real-time traffic advisory messages are displayed based on said traffic advisory data, said traffic advisory messages including at least one of upcoming traffic speed information, traffic time delay information and traffic advisory instruction information, and said plurality of sensor and said at least one variable message device are relocatably positionable relative to each other and to the work zone or roadway incident whereby locations of said plurality of sensors and said display means are reconfigurable to adapt operation of said system in accordance with current conditions and location of the work zone or roadway incident.

7. A portable system according to claim 6, further comprising:

a plurality of variable message devices operatively and relocatably positioned upstream of the work zone or roadway incident, each of said plurality of variable message devices being operatively connected to a corresponding one of said plurality of remote station controllers, wherein said central system controller is further adapted to transmit the real-time traffic advisory data to selected ones of said plurality of remote station controllers operatively connected to said plurality of variable message devices, whereby selected real-time traffic advisory messages are displayed on selected ones of said plurality of variable message devices based on the traffic advisory data.

8. A portable system according to claim 6, wherein each of said plurality of remote station controllers includes a radio modem for communicating with said central system controller, and a data processing device for processing the traffic condition data for transmission to said central system controller.

9. A portable system according to claim 6, wherein said means for providing remote communication in each of said central system controller and said plurality of remote station controllers includes a radio modem.

10. A portable system according to claim 6, wherein said means for generating real-time traffic advisory data based on the traffic condition data includes a data processing device programmed for automatic control of said plurality of traffic sensors and said at least one variable message device via said plurality of remote station controllers without operator intervention.

11. A portable system according to claim 7, wherein said means for generating real-time traffic advisory data based on the traffic condition data includes a data processing device programmed for automatic real-time control of said plurality of traffic sensors and said plurality of variable message device vias said plurality of remote station controllers without operator intervention.

12. A portable system according to claim 6, further comprising:

a supplemental traffic information transmitter device operatively located upstream of the work zone or roadway incident, said transmitter device being adapted to transmit real-time supplemental traffic information to passing motorists via radio signals based on the traffic advisory data from said central system controller, said transmitter device being operatively connected to a corresponding one of said plurality of remote station controllers.

13. A portable system according to claim 12, wherein said means for generating real-time traffic advisory data based on the traffic condition data includes a data processing device programmed for automatic real-time control of said plurality of traffic sensors, said at least one variable message device and said transmitter device via said plurality of remote station controllers without operator intervention.

14. A portable system according to claim 6, further comprising:

ramp metering device operatively located upstream of the work zone or roadway incident, said transmitter device being adapted to control entry of motorist traffic from ramps upstream of the work zone or roadway incident in real-time, said ramp metering device being operatively connected to a corresponding one of said plurality of remote station controllers.

15. A portable system according to claim 6, wherein said plurality of sensors, said at least one variable message device and said central system controller are each mounted on a transport carrier, a corresponding one of said remote station controllers for said plurality of sensors or variable message device being operatively mounted on said transport carrier.

16. A portable system according to claim 7, wherein said plurality of sensors, said plurality of variable message devices and said central system controller are each mounted on a transport carrier, a corresponding one of said remote station controllers for said plurality of sensors or variable message device being operatively mounted on said transport carrier.

17. A portable system according to claim 12, wherein said plurality of sensors, said at least one variable message device, said transmitter device and said central system controller are each mounted on a transport carrier, a corresponding one of said remote station controllers for said plurality of sensors or variable message device being operatively mounted on said transport carrier.

18. A portable system according to claim 14, wherein said plurality of sensors, said at least one variable message device, said ramp metering device and said central system controller are each mounted on a transport carrier, a corresponding one of said remote station controllers for said plurality of sensors or variable message device being operatively mounted on said transport carrier.

19. A portable system according to claim 15, wherein at least one of said plurality of sensors and said at least one variable message device are mounted together on said transport carrier.

20. A portable system according to claim 15, wherein said transport carrier includes a power supply for powering said plurality of sensors or variable message device mounted thereon.

21. A portable system according to claim 20, wherein said power supply includes a solar energy collector.

22. A portable system according to claim 20, wherein said power supply includes a diesel-powered generator.

23. A portable system according to claim 6, wherein each of said plurality of remote station controllers further includes means for relaying the traffic advisory data received from said central system controller to other selected remote station controllers.

24. A portable system according to claim 8, wherein said data processing device in each of said plurality of remote station controllers further includes means for processing the traffic advisory data received from said central system controller so as to relay the traffic advisory data to other selected remote station controllers.

25. A method for monitoring and processing traffic information at or near work zones or roadway incidents so as to provide real-time traffic advisory information to passing motorists, the method comprising the steps of:

continuously detecting current traffic conditions at least one of upstream of a work zone or roadway incident, said step of detecting the current traffic conditions includes providing a plurality of sensors upstream of the work zone or roadway incident to measure conditions indicative the current traffic conditions, said step of detecting current traffic conditions includes providing a plurality of speed sensors to measure speeds of vehicles upstream of the work zone or roadway incident and generating traffic condition data from said plurality of speed sensors;

automatically generating real-time traffic advisory data based on said detected traffic conditions;

displaying real-time traffic advisory messages to passing motorists upstream of the work zone or roadway incident based on said traffic advisory data, said step of displaying traffic advisory messages includes displaying at least one of upcoming traffic speed information, traffic time delay information and traffic advisory instruction information: and relocatably configuring locations for said continuously detecting current traffic conditions and for said displaying real-time traffic advisory messages relative to each other and to the work zone or roadway incident so as to adapt operation of said monitoring and processing of traffic information at or near the work zone or roadway incident based on current conditions and location thereof.

26. A method according to claim 25, wherein, said step of automatically generating the real-time traffic advisory data includes providing a portable central system controller, and said step of generating the real-time traffic advisory data includes processing data on the detected current traffic conditions in the central system computer.

27. A method according to claim 25, wherein said step of displaying the real-time traffic advisory data includes providing at least one variable message device relocatably positioned upstream of the work zone or roadway incident.

28. A method according to claim 26, wherein said step of displaying the real-time traffic advisory data includes providing at least one variable message device relocatably positioned upstream of the work zone or roadway incident.

29. A method according to claim 28, the method further comprising the steps of:

transmitting the traffic condition data from the plurality of sensors to the central system controller; and transmitting the real-time traffic advisory data from said central system controller to said at least one variable message device, wherein said central system controller is remotely located from said plurality of sensors and said at least one variable message device.

30. A method according to claim 28, the method further comprising the steps of:

providing a supplemental traffic information transmitter device relocatably positioned upstream of the work zone or roadway incident;

transmitting the traffic condition data from the plurality of sensors to the central system controller;

transmitting the real-time traffic advisory data from said central system controller to said at least one variable message device and said traffic advisory transmitter device, wherein said central system controller is remotely located from said plurality of sensors, said at least one variable message device and said traffic advisory data transmitter device; and transmitting real-time supplemental traffic information based on the traffic advisory data from said transmitter device to passing motorists via RF signals.

31. A method according to claim 25, the method further comprising the step of:

transmitting real-time supplemental traffic information based on the real-time traffic advisory data to passing motorists via RF signals.

32. A method according to claim 29, the method further comprising the steps of:

providing a plurality of remote station controllers each operatively connected to a corresponding one of said plurality of sensors and said at least one variable message device to control operation of a corresponding one of said sensors and said variable message device, wherein said step of transmitting the traffic condition data is conducted between a corresponding one of said remote station controllers connected to one of said sensors and said central system controller, and said step of transmitting the real-time traffic advisory data is conducted between said central system controller and a corresponding one of said remote station controllers connected to said variable message device.

33. A method according to claim 30, the method further comprising the step of:

providing a plurality of remote station controllers each operatively connected to a corresponding one of said plurality of sensors, said at least one variable message device and said real-time traffic advisory data transmitter device to control operation of a corresponding one of said sensors, said variable message device and said transmitter device, wherein said step of transmitting the traffic condition data is conducted between a corresponding one of said remote station controllers connected to one of said sensors and said central system controller, and said step of transmitting the real-time traffic advisory data is conducted between said central system controller and corresponding ones of said remote station controllers connected to said variable message device and said transmitter device.

34. A method according to claim 26, wherein said step of displaying the real-time traffic advisory data includes providing a plurality of variable message devices relocatably positioned upstream of the work zone or roadway incident.

35. A method according to claim 34, the method further comprising the steps of:

transmitting the traffic condition data from the plurality of sensors to the central system controller; and transmitting the real-time traffic advisory data from said central system controller to said plurality of variable message devices, wherein said central system controller is remotely located from said plurality of sensors and said plurality of variable message devices, and said step of generating the traffic advisory data further includes generating selected real-time traffic advisory data messages for corresponding ones of said plurality of variable message devices whereby the selected traffic advisory data messages are only displayed by said corresponding variable message devices.

36. A method according to claim 34, the method further comprising the steps of:

providing a traffic advisory data transmitter device relocatably positioned upstream of the work zone or roadway incident;

transmitting the traffic condition data from the plurality of sensors to the central system controller;

transmitting the real-time traffic advisory data from said central system controller to said plurality of variable message devices and said traffic advisory data transmitter device; and transmitting supplemental traffic information based on the real-time traffic advisory data from said transmitter device to passing motorists via RF signals, wherein said central system controller is remotely located from said plurality of sensors, said plurality of variable message devices and said traffic advisory data transmitter, and said step of generating the real-time traffic advisory data further includes generating selected real-time traffic advisory data messages for corresponding ones of said plurality of variable message devices and said traffic advisory data transmitter whereby the selected traffic advisory data messages are at least one of only displayed and transmitted by a corresponding one of said variable message devices and said transmitter device.

37. A method according to claim 35, the method further comprising the step of:

providing a plurality of remote station controllers each operatively connected to a corresponding one of said plurality of sensors and said plurality of variable message devices to control operation of a corresponding one of said sensors and said variable message devices, wherein said step of transmitting the traffic condition data is conducted between a corresponding one of said remote station controllers connected to one of said sensors and said central system controller, and said step of transmitting the selected traffic advisory data messages is conducted between said central system controller and said remote station controllers connected corresponding ones of said variable message devices.

38. A method according to claim 36, the method further comprising the step of:

providing a plurality of remote station controllers each operatively connected to a corresponding one of said plurality of sensors, said plurality of variable message devices and said traffic advisory data transmitter device to control operation of a corresponding one of said sensors, said variable message devices and said transmitter device, wherein said step of transmitting the traffic condition data is conducted between a corresponding one of said remote station controllers connected to one of said sensors and said central system controller, and said step of transmitting the traffic advisory data messages is conducted between said central system controller and said remote station controllers connected to corresponding ones of said variable message devices and said transmitter device.

39. A method according to claim 37, wherein said step of generating the traffic advisory data further includes generating selected traffic advisory data messages for corresponding ones of said plurality of variable message devices, whereby the selected traffic advisory data messages are relayed to said corresponding variable message devices via remote station controllers of at least non-corresponding variable message devices.

40. A method according to claim 38, wherein said step of generating the traffic advisory data further includes generating selected real-time traffic advisory data messages for corresponding ones of said plurality of variable message devices and traffic advisory data transmitter device, whereby the selected real-time traffic advisory data messages are relayed to one of said corresponding variable message devices and transmitter device via remote station controllers of at least non-corresponding variable message devices.

41. A method according to claim 25, further comprising the step of:

controlling entry of motorist traffic from ramps upstream of the work zone or roadway incident in real-time based on said detected traffic conditions, said step of controlling motorist traffic entry including providing a ramp metering device at an entry ramp upstream of the work zone or roadway incident.

42. A method according to claim 32, further comprising the step of:

controlling entry of motorist traffic from ramps upstream of the work zone or roadway incident based on said detected traffic conditions, said step of controlling motorist traffic entry including providing a ramp metering device at an entry ramp upstream of the work zone or roadway incident and connected to a corresponding one of said plurality of remote station controllers.

43. A method according to claim 33, further comprising the step of:

controlling entry of motorist traffic from ramps upstream of the work zone or roadway incident based on said detected traffic conditions, said step of controlling motorist traffic entry including providing a ramp metering device at an entry ramp upstream of the work zone or roadway incident and connected to a corresponding one of said plurality of remote station controllers.

44. A method according to claim 37, further comprising the step of:

controlling entry of motorist traffic from ramps upstream of the work zone or roadway incident based on said detected traffic conditions, said step of controlling motorist traffic entry including providing a ramp metering device at an entry ramp upstream of the work zone or roadway incident and connected to a corresponding one of said plurality of remote station controllers.

45. A method according to claim 38, further comprising the step of:

controlling entry of motorist traffic from ramps upstream of the work zone or roadway incident based on said detected traffic conditions, said step of controlling motorist traffic entry including providing a ramp metering device at an entry ramp upstream of the work zone or roadway incident and connected to a corresponding one of said plurality of remote station controllers.

46. A method for controlling operation of an automated traffic information monitoring and processing system that includes at least a plurality of sensors for detecting current traffic conditions, at least one variable message device, a plurality of remote station controllers each operatively connected to corresponding ones of the plurality of sensors and the at least one variable message device, and a central system controller operatively located within remote communication range of the plurality of remote station controllers, said method comprising the steps of:

relocatably positioning said plurality of sensors upstream of the work zone or roadway incident:

detecting current traffic conditions from said plurality of sensors based on speeds of vehicles in traffic upstream of the work zone or roadway incident;

receiving traffic condition data from remote station controllers connected to the plurality of sensors, the sensors continuously detecting traffic conditions upstream of a work zone or roadway incident in real-time;

generating real-time traffic advisory data via the central system controller based on the received traffic condition data;

transmitting the real-time traffic advisory data to the plurality of remote station controllers;

processing the real-time traffic advisory data in each of the plurality of remote station controllers;

relocatably positioning the at least one variable message device upstream of the work zone or roadway incident;

displaying real-time traffic advisory messages on the at least one variable message device, said traffic advisory messages including at least one of upcoming traffic speed information, traffic time delay information and traffic advisory instruction information; and configuring locations of said plurality of sensors and said at least one variable message device relative to each other and to the work zone or roadway incident so as to adapt operation of said automated traffic information monitoring and processing system at or near the work zone or roadway incident based on current conditions and location thereof.

47. A method according to claim 46, further comprising the step of:

transmitting supplemental traffic information via RF signals to passing motorists in real-time using a supplemental traffic information transmitter device operatively connected to a corresponding one of said plurality of remote station controllers.

48. A method according to claim 46, wherein the automated traffic information monitoring and processing system further includes a plurality of variable message devices each connected to a corresponding one of said plurality of remote station controllers, said step of generating real-time traffic advisory data via the central system controller based on the received traffic condition data including generating real-time traffic advisory data packets specific to each of said plurality of remote station controllers corresponding to said plurality of variable message devices.

49. A method according to claim 48, wherein said step of processing the real-time traffic advisory data in each of the plurality of remote station controllers includes determining whether a received traffic advisory data packet corresponds to a receiving remote station controller, and processing a correctly corresponding received traffic advisory data packet so as to at least display a real-time traffic advisory message on a corresponding variable message display based on the correctly corresponding received traffic advisory data packet.

50. A method according to claim 49, wherein said step of processing the real-time traffic advisory data in each of the plurality of remote station controllers further includes re-transmitting a non-corresponding received traffic advisory data packet so as to be relayed to others of said plurality of remote station controllers.

* * * * *

US006064318C1

(12) EX PARTE REEXAMINATION CERTIFICATE (5025th)

United States Patent

Kirchner, III et al.

(10) Number: US 6,064,318 C1

(45) Certificate Issued: Nov. 23, 2004

(54) AUTOMATED DATA ACQUISITION AND PROCESSING OF TRAFFIC INFORMATION IN REAL-TIME SYSTEM AND METHOD OF SAME

(76) Inventors: Albert H. Kirchner, III, 11205 Birmingham Ct., Great Falls, VA (US) 22066; Loren Staplin, 1743 Valley Forge Rd., Allentown, PA (US) 18104; Kenneth W. Gish, 4100 Salford Ct., Bensalem, PA (US) 19020

Reexamination Request:
No. 90/006,512, Jan. 13, 2003

Reexamination Certificate for:

| | |
|---|---|
| Patent No.: | **6,064,318** |
| Issued: | **May 16, 2000** |
| Appl. No.: | **08/873,239** |
| Filed: | **Jun. 11, 1997** |

(51) Int. Cl.[7] ..... G08G 1/09

(52) U.S. Cl. ..... 340/905; 340/908; 340/933; 340/936; 340/937

(58) Field of Search ..... 340/933, 936, 340/908, 937, 589, 904, 905, 916, 917, 919

(56) References Cited

U.S. PATENT DOCUMENTS

| | | | | |
|---|---|---|---|---|
| 5,289,183 A | | 2/1994 | Hassett et al. | 340/905 |
| 5,296,852 A | | 3/1994 | Rathi | 340/933 |
| 5,337,082 A | | 8/1994 | Fredericks | 342/114 |
| 5,396,429 A | * | 3/1995 | Hanchett | 701/117 |
| 5,420,794 A | | 5/1995 | James | 340/932 |
| 5,801,943 A | | 9/1998 | Nasburg | 340/910 |
| 5,822,712 A | * | 10/1998 | Olsson | 701/117 |

OTHER PUBLICATIONS

California Dept. of Transportation, Orange County IVHS Partners, Mobile Video Surveillance/Wireless Communication System for Advanced Traffic Management (Proposed IVHS Field Operational Test), prepared for the Federal Highway Administration in response to Request for Participation, Jul. 20, 1992, Federal Register vol. 57, No. 139, Federal Highway Administration.

M. Nookala, Portable Traffic Management System (PTMS), Final System Design, Jun., 1995, Castle Rock Consultants, Portland, Oregon.

The Scientex Corporation, Proposal For Conducting A Research Project To Design, Implement And Evaluate A Condition–Responsive Work Zone Traffic Control System, cover page, pp. i–iv, pp. 1–32, dated Nov. 30, 1992.

(List continued on next page.)

*Primary Examiner*—Brent Swarthout

(57) ABSTRACT

The present invention is directed to a portable system for automatic data acquisition and processing of traffic information in real-time. The system incorporates a plurality of sensors operatively positioned upstream of a work zone or roadway incident with each of the sensors being adapted to detect current traffic conditions, at least one variable message device positioned upstream of the work zone or roadway incident, a plurality of remote station controllers, each operatively connected to the plurality of sensors and the variable message device, and a central system controller located within remote communication range of the remote station controllers, wherein the central system controller and the plurality of remote station controllers are capable of remotely communicating with one another. Each of the sensors is adapted to output traffic condition data to its corresponding remote station controller. The corresponding remote station controllers then transmit the traffic condition data to the central system controller. The central system controller automatically generates traffic advisory data based on the traffic condition data and transmits the traffic advisory data to the remote station controller that is connected to the variable message device. The traffic advisory data may also be used to communicate with and control highway advisory radio transmitters and ramp metering stations. Together, one or more variable message devices, highway advisory radio transmitters and ramp metering stations may be used to inform passing motorists of traffic conditions in and around a work zone or roadway incident, and thereby control and improve the safety and efficiency of traffic operations around such sites.

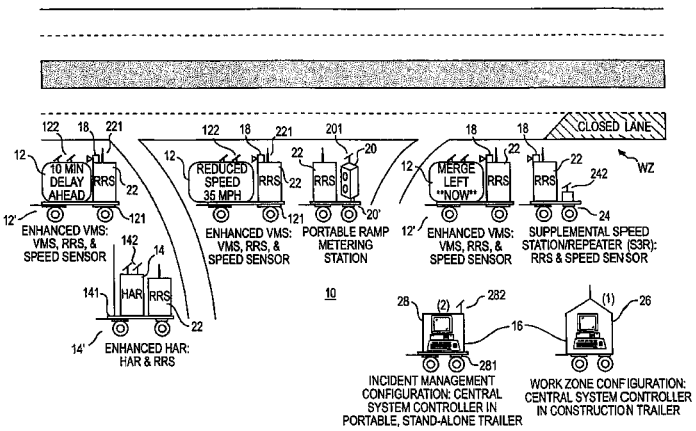

OTHER PUBLICATIONS

The Scientex Corporation, Work Order 1 Final Report, cover page, pp. 2–99, dated Feb. 21, 1994.

The Scientex Corporation, Human Factors Studies, The High– Level Design of a Condition–Responsive Work Zone Traffic Control System, cover page, pp. 1–27, dated Mar. 22, 1995.

The Scientex Corporation, Operator's Manual for the Condition Responsive Work Zone Traffic Control System, cover page, pp. i–ii, pp. 1–30 and 32, dated Jul. 10, 1995.

The Scientex Corporation, System Evaluation Plan for the Condition–Responsive Work Zone Traffic Control System (WZTCS), cover page, pp. 1–12, dated Aug. 18, 1995.

The Scientex Corporation, System Evaluation Plan for the Condition–Responsive Work Zone Traffic Control System (WZTCS), cover page, p. i, pp. 1–24, an additional page, revised, dated Dec. 7, 1995.

The Scientex Corporation, Work Zone Traffic Control System, Monthly Progress Report, one page, Apr. 1–30, 1997.

The Scientex Corporation, Work Zone Traffic Control System, Monthly Progress Report, one page, May 1–31, 1997.

The Scientex Corporation, Monthly Progress Report, one page, Sep. 1–30, 1997.

The Scientex Corporation, Operator's Manual for the Condition–Responsive Work Zone Traffic Control System (WZTCS), cover page, pp. i–iii, pp. 1–39, revised Aug. 19, 1996.

The Scientex Corporation, draft of a revised Work Zone Traffic Control System (WZTCS) User's Manual, pp. i–ii, pp. 1–18, Appendix A including cover page and pages A–1–A–8, page for Appendix B, page for Appendix C, early 1997–believed finalized by Apr. 30, 1997.

The Scientex Corporation, draft of a revised Work Zone Traffic Control System (WZTCS) Operator's Manual, pp. i–iii, pp. 1–47, early 1997–believed finalized by Apr. 30, 1997.

The Scientex Corporation, ADAPTIR™, general description of the WZTCS system , pp. 1–8, prepared in 1997 (before Jun. 11, 1997).

The Scientex Corporation, operational system communications protocol and related software, Appendix A—System Communications Protocol, Appendix B—System Data Packet Format, Appendic C, 16 pages total, sometime between Mar., 1994–Jun., 1997.

"Proceedings of the 1996 Annual Meetings of ITS America", vol. 1, pp. cover and copyright pages, Mission Statement page, page including a letter dated Jun. 21, 1996 from the President of ITS America, Nookala, et al., "Advanced Portable Traffic Management System Work Zone Operational Test", pp. 402–411, Jun. 21, 1996.

Research Proposal, "A Portable Real–Time Traffic Control System for Highway Work Zones", principal investigator Prahlad D. Pant, cover page, table of contents page, list of tables and list of figures page, pp. 1–19, Appendix cover page, Curriculum Vitae—5 pages, 5 additional pages, revised, dated Jun. 24, 1993.

FHWA Research and Technology Transporter, Transporter On– Line, Sep. 1996 Transporter–ITS, John McCracken, "New Traffic Control System Handbook Includes ITS Technologies", "Sep. 1996 Table of Contents", 2 pages, Sep., 1996.

Internet pages, downloaded Mar. 19, 2003, from Sep. 1996 Transporter–ITS, "New Traffic Control Systems Handbook Includes ITS Technologies" John McCracken, 2 pages, Sep., 1996.

"Work Order 1 Final Report—The High Level Design of a Condition–Responsive Work Zone Traffic Control System", publicly available as part of Federal–aid project No. RDT&T–001(375)N, Sep. 25, 1995.

Marthland Nookala, et al., "Advanced Portable Traffice Management System Work Zone Operational Test", published as late as Apr. 18, 1996, Intelligent Transportation Systems, ITC.

Prahlad D. Pant, "A Portable Real–Time Traffic Control System of Highway Work Zones—Phase I", publicly available as part of Federal–aid project No. HPR–2(029) (Ohio State Job Number 14560(0)), Sep. 18, 1993.

"Traffic Control Systems Handbook", distributed by the Federal Highway Administration no later than Feb., 1996.

Jose V. Thommana, "Real–Time Advanced Warning and Traffic Control Systems for Work Zones: Examination of Requirements and Issues", Published May 30, 1997, Virginia Polytechnic Institute and State University.

Prahlad D. Pant, Marious M. Polycarpou & Arun T. Vemuri, "Short–Term Forecasting of Traffic Delays in Highway Construction Zones Using Neural Networks", Published no later than Apr. 11, 1996 during a converence sponsored by the George Washington University and the United States Highway Administration entitled, "Neural Network Applications in Highway and Vehicle Engineering", held Apr. 10–11, 1996.

Laurie Petrie, "I–70 Jam Wanring Tested", Published Apr. 11, 1996, the Cincinnati Post.

Federal Highway Administration Records on Federal–aid project No. RDT&T–001(375)N, "Work Zone Traffic Control System." Publicly Available at least since May 1, 1996.

Prahlad D. Pant and Marious M Polycarpou, "Intelligent Traffic Control System for Highway Work Zones", published between May 22–26, 1995, IEEE 1995 National, vol. 1 (pp. 348–351).

John Johnson, "UC Prof's Invention Helps Calm the Orange Barrel Blues", published Mwy 21, 1995, the Cincinnati Enquirer.

Prahlad D. Pant, "Portable Real–Time Traffic Control System for Highway Work Zones", publicly available as part of Federal–aid project No. HPR–2(029) (Ohio State Job Number 14560(0)), since at least Jun. 1, 1995.

Chris Curran, "Engineering Research Aims at Canning Wait Through Construction", published Apr. 7, 1995, Current, the University of Cincinnati publication.

Marthland Nookala, et al., "Portable Traffic–Management System: an ITS Operation Test", published no later than Mar. 17, 1995, as part of "The Proceedings of the 1995 Annual Meetings of ITS America" in Washington DC, entitled, "Intelligent Transportation: Serving the User Through Deployment" Mar. 15–18, 1995.

Prahlad D. Pant, "Portable Real–Time Traffic Control System for Highway Work Zones", publicly available as part of Federal–aid project No. HPR–2(029) (Ohio State Job Number 14560(0)), since at least Jan. 1, 1995.

Howard Bissell, "How Will Advanced Technology Be Applied for Highway Safety?", published no later than Sep. 22, 1992, Compendium of Technical Papers distributed Sep. 19–22, 1993, during the 63rd Meeting of the Institute of Transportation Engineers in the Hague, the Netherlands.

Part VI of the "Manual on Uniform Traffic Control Devices (MUTCD)", published no later than Sep. 3, 1993, the United States Federal Hishway Administration.

"Communications Handbook for Traffic Control Systems", published no later than Apr., 1993, Office of Technology Applications of the United States Federal Highway Administration.

Greg Helgeson, "Special Traffic Management Techniques for 1989 Wisconsin Interstate 90 Construction: Changeable Message Signs (CMS) Highway Advisory Radio (HAR)", published no later than Feb., 1990, United States Federal Highway Administration, Wisconsin Regional Office.

"Traffic Control System Handbook", published no later than Apr., 1985, the United States Federal Highway Administration (pp. 9.11–9.18).

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–24 is confirmed.

Claims 25, 26, 30, 31, 35, 36, 46, 47 and 48 are determined to be patentable as amended.

Claims 27–29, 32–34, 37–45 and 49–50, dependent on an amended claim, are determined to be patentable.

25. A method for monitoring and processing traffic information at or near work zones or roadway incidents so as to provide real-time traffic advisory information to passing motorists, the method comprising the steps of:

continuously detecting current traffic conditions at least one of upstream of a work zone or roadway incident, said step of detecting the current traffic conditions includes providing a plurality of sensors upstream of the work zone or roadway incident to measure conditions indicative *of* the current traffic conditions, said step of detecting current traffic conditions includes providing a plurality of speed sensors to measure speeds of vehicles upstream of the work zone or roadway incident and generating traffic condition data from said plurality of speed sensors;

automatically generating real-time traffic advisory data based on said detected traffic conditions;

displaying real-time traffic advisory messages to passing motorists upstream of the work zone or roadway incident based on said traffic advisory data, said step of displaying traffic advisory messages includes displaying at least one of upcoming traffic speed information, traffic time delay information and traffic advisory instruction information [:]; and

*intelligently controlling* relocatably configuring locations for said continuously detecting current traffic conditions, *including relocatably configuring locations for said plurality of sensors,* and for *selectively activating* and displaying real-time traffic advisory messages relative to each other and to the work zone or roadway incident so as to adapt operation of said monitoring and processing of traffic information at or near the work zone or roadway incident based on current conditions and location thereof.

26. A method according to claim 25, wherein, said step of automatically generating the real-time traffic advisory data includes providing a portable central system controller, and said step of generating the real-time traffic advisory data includes processing data on the detected current traffic conditions in the central system [computer] *controller*.

30. A method [according to claim 28,] *for monitoring and processing traffic information at or near work zones or roadway incidents so as to provide real-time traffic advisory information to passing motorists,* the method [further] comprising the steps of:

*continuously detecting current traffic conditions at least one of upstream of a work zone or roadway incident, said step of detecting the current traffic conditions includes providing a plurality of sensors upstream of the work zone or roadway incident to measure conditions indicative of the current traffic conditions, said step of detecting current traffic conditions includes providing a plurality of speed sensors to measure speeds of vehicles upstream of the work zone or roadway incident and generating traffic condition data from said plurality of speed sensors;*

*automatically generating real-time traffic advisory data based on said detected traffic conditions, said step of automatically generating the real-time traffic advisory data includes providing a portable central system controller, and said step of generating the real-time traffic advisory data includes processing data on the detected current traffic conditions in the central system controller;*

*displaying real-time traffic advisory messages to passing motorists upstream of the work zone or roadway incident based on said traffic advisory data, said step of displaying traffic advisory messages includes displaying at least one of upcoming traffic speed information, traffic time delay information and traffic advisory instruction information, and said step of displaying the real-time traffic advisory data includes providing at least one variable message device relocatably positioned upstream of the work zone or roadway incident;*

*relocatably configuring locations for said continuously detecting current traffic conditions and for said displaying real-time traffic advisory messages relative to each other and to the work zone or roadway incident so as to adapt operation of said monitoring and processing of traffic information at or near the work zone or roadway incident based on current conditions and location thereof;* providing a supplemental traffic information transmitter device relocatably positioned upstream of the work zone or roadway incident;

transmitting the traffic condition data from the plurality of sensors to the central system controller;

transmitting the real-time traffic advisory data from said central system controller to said at least one variable message device and said traffic advisory transmitter device, wherein said central system controller is remotely located from said plurality of sensors, said at least one variable message device and said traffic advisory data transmitter device; and transmitting real-time supplemental traffic information based on the traffic advisory data from said transmitter device to passing motorists via RF signals.

31. A method [according to claim 25,] *for monitoring and processing traffic information at or near work zones or roadway incidents so as to provide real-time traffic advisory information to passing motorists,* the method [further] comprising the steps of:

*continuously detecting current traffic conditions at least one of upstream of a work zone or roadway incident, said step of detecting the current traffic conditions includes providing a plurality of sensors upstream of the work zone or roadway incident to measure conditions indicative of the current traffic conditions, said step of detecting current traffic conditions includes*

*providing a plurality of speed sensors to measure speeds of vehicles upstream of the work zone or roadway incident and generating traffic condition data from said plurality of speed sensors;*

*automatically generating real-time traffic advisory data based on said detected traffic conditions;*

*displaying real-time traffic advisory messages to passing motorists upstream of the work zone or roadway incident based on said traffic advisory data, said step of displaying traffic advisory messages includes displaying at least one of upcoming traffic speed information, traffic time delay information and traffic advisory instruction information;*

*relocatably configuring locations for said continuously detecting current traffic conditions and for said displaying real-time traffic advisory messages relative to each other and to the work zone or roadway incident so as to adapt operation of said monitoring and processing of traffic information at or near the work zone or roadway incident based on current conditions and location thereof; and* transmitting real-time supplemental traffic information based on the real-time traffic advisory data to passing motorists via RF signals.

35. A method [according to claim 34,] *for monitoring and processing traffic information at or near work zones or roadway incidents so as to provide real-time traffic advisory information to passing motorists,* the method [further] comprising the steps of:

*continuously detecting current traffic conditions at least one of upstream of a work zone or roadway incident, said step of detecting the current traffic conditions includes providing a plurality of sensors upstream of the work zone or roadway incident to measure conditions indicative of the current traffic conditions, said step of detecting current traffic conditions includes providing a plurality of speed sensors to measure speeds of vehicles upstream of the work zone or roadway incident and generating traffic condition data from said plurality of speed sensors;*

*automatically generating real-time traffic advisory data based on said detected traffic conditions, said step of automatically generating the real-time traffic advisory data includes providing a portable central system controller, and said step of generating the real-time traffic advisory data includes processing data on the detected current traffic conditions in the central system controller;*

*displaying real-time traffic advisory messages to passing motorists upstream of the work zone or roadway incident based on said traffic advisory data, said step of displaying traffic advisory messages includes displaying at least one of upcoming traffic speed information, traffic time delay information and traffic advisory instruction information, and said step of displaying the real-time traffic advisory data includes providing a plurality of variable message devices relocatably positioned upstream of the work zone or roadway incident;*

*relocatably configuring locations for said continuously detecting current traffic conditions and for said displaying real-time traffic advisory messages relative to each other and to the work zone or roadway incident so as to adapt operation of said monitoring and processing of traffic information at or near the work zone or roadway incident based on current conditions and location thereof;* transmitting the traffic condition data from the plurality of sensors to the central system controller; and transmitting the real-time traffic advisory data from said central system controller to said plurality of variable message devices, wherein said central system controller is remotely located from said plurality of sensors and said plurality of variable message devices, and said step of generating the traffic advisory data further includes generating selected real-time traffic advisory data messages for corresponding ones of said plurality of variable message devices whereby the selected traffic advisory data messages are only displayed by said corresponding variable message devices.

36. A method [according to claim 34,] *for monitoring and processing traffic information at or near work zones or roadway incidents so as to provide real-time traffic advisory information to passing motorists,* the method [further] comprising the steps of:

*continuously detecting current traffic conditions at least one of upstream of a work zone or roadway incident, said step of detecting the current traffic conditions includes providing a plurality of sensors upstream of the work zone or roadway incident to measure conditions indicative of the current traffic conditions, said step of detecting current traffic conditions includes a plurality of speed sensors to measure speeds of vehicles upstream of the work zone or roadway incident and generating traffic condition data from said plurality of speed sensors;*

*automatically generating real-time traffic advisory data based on said detected traffic conditions, said step of sutomatically generating the real-time traffic advisory data includes probiding a portable central system controller, and said step of generating the real-time traffic advisory data includes processing data on the detected current traffic conditions in the central system controller;*

*displaying real-time traffic advisory messages to passing motorists upstream of the work zone or roadway incident based on said traffic advisory data, said step of displaying traffic advisory messages includes displaying at least one of upcoming traffic speed information, traffic time delay information and traffic advisory instruction information, and said step of displaying the real-time traffic advisory data includes providing a plurality of variable message devices relocatably positioned upstream of the work zone or roadway incident;*

*relocatably configuring locations for said continuously detecting current traffic conditions and for said displaying real-time traffic advisory messages relative to each other and to the work zone or roadway incident so as to adapt operation of said monitoring and processing of traffic information at or near the work zone or roadway incident based on current conditions and location thereof;* providing a traffic advisory data transmitter device relocatably positioned upstream of the work zone or roadway incident;

transmitting the traffic condition data from the plurality of sensors to the central system controller;

transmitting the real-time traffic advisory data from said central system controller to said plurality of variable message devices and said traffic advisory data transmitter device; and transmitting supplemental traffic information based on the real-time traffic advisory data from said transmitter device to passing motorists via RF signals, wherein said central system controller is remotely located from said plurality of sensors, said plurality of variable message devices and said traffic advisory data transmitter, and said step of generating the real-time traffic advisory data further includes generating selected real-time traffic advisory data messages for corresponding ones of said plurality of variable message devices and said traffic advisory data transmitter whereby the selected traffic advisory data messages are at least one of only displayed and transmitted by a corresponding one of said variable message devices and said transmitter device.

46. A method for controlling operation of an automated traffic information monitoring and processing system that includes at least a plurality of sensors for detecting current traffic conditions, at least one variable message device, a plurality of remote station controllers each operatively connected to corresponding ones of the plurality of sensors and the at least one variable message device, and a central system controller operatively located within remote communication range of the plurality of remote station controllers, said method comprising the steps of:

relocatably positioning said plurality of sensors upstream of the work zone or roadway incident[:];

detecting current traffic conditions from said plurality of sensors based on speeds of vehicles in traffic upstream of the work zone or roadway incident;

receiving traffic condition data from remote station controllers connected to the plurality of sensors, the sensors continuously detecting traffic conditions upstream of a work zone or roadway incident in real-time;

generating real-time traffic advisory data via the central system controller based on the received traffic condition data;

transmitting the real-time traffic advisory data to the plurality of remote station controllers;

processing the real-time traffic advisory data in each of the plurality of remote station controllers;

relocatably positioning the at least one variable message device upstream of the work zone or roadway incident;

displaying real-time traffic advisory messages on the at least one variable message device, said traffic advisory messages including at least one of upcoming traffic speed information, traffic time delay information and traffic advisory instruction information; and

*intelligently controlling* configuring locations of said plurality of sensors and said at least one variable message device relative to each other and to the work zone or roadway incident so as to *selectively activate said at least one variable message device and* adapt operation of said automated traffic information monitoring and processing system at or near the work zone or roadway incident based on current conditions and location thereof.

47. A method [according to claim 46, further] *for controlling operation of an automated traffic information monitoring and processing system that includes at least a plurality of sensors for detecting current traffic conditions, at least one variable message device, a plurality of remote station controllers each operatively connected to corresponding ones of the plurality of sensors and the at least one variable message device, and a central system controller operatively located within remote communication range of the plurality of remote station controllers, said method* comprising the steps of:

*relocatably positioning said plurality of sensors upstream of the work zone or roadway incident;*

*detecting current traffic conditions from said plurality of sensors based on speeds of vehicles in traffic upstream of the work zone or roadway incident;*

*receiving traffic condition data from remote station controllers connected to the plurality of sensors, the sensors continuously detecting traffic conditions upstream of a work zone or roadway incident in real-time;*

*generating real-time traffic advisory data via the central system controller based on the received traffic condition data;*

*transmitting the real-time traffic advisory data to the plurality of remote station controllers;*

*processing the real-time traffic advisory data in each of the plurality of remote station controllers;*

*relocatably positioning the at least one variable message device upstream of the work zone or roadway incident;*

*displaying real-time traffic advisory messages on the at least one variable message device, said traffic advisory messages including at least one of upcoming traffic speed information, traffic time delay information and traffic advisory instruction information;*

*configuring locations of said plurality of sensors and said at least one variable message device relative to each other and to the work zone or roadway incident so as to adapt operation of said automated traffic information monitoring and processing system at or near the work zone or roadway incident based on current conditions and location thereof; and* transmitting supplemental traffic information via RF signals to passing motorists in real-time using a supplemental traffic information transmitter device operatively connected to a corresponding one of said plurality of remote station controllers.

48. A method [according to claim 46] *for controlling operation of an automated traffic information monitoring and processing system that includes at least a plurality of sensors for detecting current traffic conditions, at least one variable message device, a plurality of remote station controllers each operatively connected to corresponding ones of the plurality of sensors and the at least one variable message device, and a central system controller operatively located within remote communication renage of the plurality of remote station controllers, said method comprising the steps of:*

*relocatably positioning said plurality of sensors upstream of the work zone or roadway incident;*

*detecting current traffic conditions from said plurality of sensors based on speeds of vehicles in traffic upstream of the work zone or roadway incident;*

*receiving traffic condition data from remote station controllers connected to the plurality of sensors, the sensors continuously detecting traffic conditions upstream of a work zone or roadway incident in real-time;*

*generating real-time traffic advisory data via the central system controller based on the received traffic condition data;*

*transmitting the real-time traffic advisory data to the plurality of remote station controllers;*

*processing the real-time traffic advisory data in each of the plurality of remote station controllers;*

*relocatably positioning the at least one variable message device upstream of the work zone or roadway incident;*

*displaying real-time traffic advisory messages on the at least one variable message device, said traffic advisory messages including at least one of upcoming traffic speed information, traffic time delay information and traffic advisory instruction information;*

*configuring locations of said plurality of sensors and said at least one variable message device relative to each other and to the work zone or roadway incident so as to adapt operation of said automated traffic information monitoring and processing system at or near the work zone or roadway incident based on current conditions and location thereof*, wherein the automated traffic information monitoring and processing system further includes a plurality of variable message devices each connected to a corresponding one of said plurality of remote station controllers, said step of generating real-time traffic advisory data via the central system controller based on the received traffic condition data including generating real-time traffic advisory data packets specific to each of said plurality of remote station controllers corresponding to said plurality of variable message devices.

* * * * *